US006049689A

United States Patent [19]

Ishii et al.

[11] Patent Number: 6,049,689

[45] Date of Patent: Apr. 11, 2000

[54] DEVELOPING APPARATUS WITH VIBRATION ABSORBTION DEVICE

[75] Inventors: Hiroshi Ishii, Kashihara; Eiichi Kido, Yamatokoriyama; Tetsuro Toyoshima, Kyoto; Takashi Sakai, Nara; Tadashi Iwamatsu, Nara; Hiroshi Tatsumi, Nara, all of Japan

[73] Assignee: Sharp Kabushiki Kaisha, Osaka, Japan

[21] Appl. No.: 09/131,389

[22] Filed: Aug. 7, 1998

[30] Foreign Application Priority Data

Aug. 8, 1997 [JP] Japan ..... 9-214621

[51] Int. Cl.[7] ..... G03G 15/08; B05C 1/06

[52] U.S. Cl. ..... 399/284; 118/261

[58] Field of Search ..... 399/55, 102, 103, 399/105, 261, 281, 284, 285, 350, 351; 118/261; 222/DIG. 1; 430/120

[56] References Cited

U.S. PATENT DOCUMENTS 5,134,960 8/1992 Shirai ..... 399/103
5,502,547 3/1996 Shirai ..... 399/103
5,895,150 4/1999 Watabe et al. ..... 399/284

FOREIGN PATENT DOCUMENTS 1-198778 8/1989 Japan .
4-3188 1/1992 Japan .
8-137247 5/1993 Japan .

*Primary Examiner*—Fred L. Braun
*Assistant Examiner*—Hoang Ngo

[57] ABSTRACT

A developing apparatus includes a toner carrier for transferring toner to a development position, a layer-thickness regulating member for forming a toner layer having a predetermined thickness on the toner carrier by making contact in a leading edge or a surface of a vicinity of the leading edge with the toner carrier, and a supplier for supplying a one-component toner to the toner carrier. Also combined with the layer-thickness layer is a vibration absorbing device allowing the toner to be applied in a uniform thickness. The vibration absorbing device can also be a sealing member located on the toner carrier. Each sealing member can be two different materials effective to absorb vibration.

14 Claims, 8 Drawing Sheets

DEVELOPING APPARATUS WITH VIBRATION ABSORBTION DEVICE

BACKGROUND OF THE INVENTION

1. Field of the Invention

The present invention relates to a developing apparatus utilizing a one-component type toner and more particularly, to a developing apparatus for use in image forming apparatuses utilizing an electrostatic latent image, such as electrophotographic copying machines and the like.

2. Description of the Related Art

A conventional development technique employed by the developing apparatus for use in the electrophotographic copying machines, which utilizes the one-component type toner, is generally arranged such that a layer-thickness regulating member is in widthwise contact with a rotated toner carrier for uniformalizing a thin toner layer on the toner carrier while the toner is imparted with a charge required for image development through triboelectrification, charge injection or a combination of both techniques. According to a well-known development technique, the thin toner layer is transported to a contact portion between an image bearing member and the toner carrier for development of an electrostatic latent image on the image bearing member.

In order to accomplish stable layer-thickness regulation as one of the conditions for forming images of good quality, this technique typically adopts a method in which the layer-thickness regulating member, such as of a cantilevered structure formed of a metal sheet, a high polymer resin or a lamination of both materials, has its surface or leading edge abutted against the toner carrier via the toner.

Unfortunately, the prior-art layer-thickness regulating member suffers an occurrence of vibration thereof which may result from a changed abutment state due to the deterioration thereof with time, stick slip associated with the rotation of the developer carrier, vibration transferred from a drive source such as a motor, foreign matters entered in or deposited at the abutment portion or the like. Such a vibration interferes with the forming of a toner layer of a uniform thickness, thus resulting in images with quality lowered by density variations, unwanted tone variations, fogs, contamination and the like. Additionally, the vibration of the layer-thickness regulating member also causes the toner to be scattered or spilled from a developer chamber and hence, contamination of resultant images, increases in toner consumption, a contaminated interior of the apparatus with the toner or the like will result.

Furthermore, at opposite sealing portions of the layer-thickness regulating member which are pressed against sealing members for preventing the toner from being scattered or spilled from opposite end portions thereof, the vibration of the layer-thickness regulating member associated with the rotation of the developer carrier causes a similar toner sealing failure to the above. Such a toner sealing failure causes the toner to be scattered or spilled, thus resulting in drawbacks such as contamination of resultant images or the interior of the apparatus, an increased toner consumption and the like.

The sealing portions of the layer-thickness regulating member are particularly susceptible to the vibration because the sealing portions define edge portions of the layer-thickness regulating member, and the layer-thickness regulating member tends to be in direct contact with a surface of the rotating toner carrier without the toner interposed therebetween, the toner preliminarily removed by the sealing member upstream of the sealing portions. In addition, there is a fear that the sealing portions themselves may produce the vibration which causes a toner leakage therefrom or which is transferred to the layer-thickness regulating member thereby to drive the regulating member into vibration.

SUMMARY OF THE INVENTION

In view of the foregoing problems, it is an object of the invention to provide a developing apparatus permitting the layer-thickness regulating member to absorb vibrational energy (hereinafter referred to simply as "vibration damping") for control of the vibration thereof such that a uniform toner layer in thickness may be formed for accomplishing images of good quality.

In view of the foregoing problems, it is another object of the invention to reduce the vibration of the layer-thickness regulating member or the sealing members by way of the layer-thickness regulating member or the sealing members adapted to absorb the vibrational energy whereby the toner sealing failure is prevented.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier; and a supplier for supplying one-component toner to the toner carrier, wherein the layer-thickness regulating member is a combination of a layer forming member for forming the toner layer and a vibration damping member for absorbing vibrational energy.

According to the developing apparatus of the invention, the layer-thickness regulating member is adapted to absorb the vibrational energy for controlling the vibration thereof so that a toner layer may be formed in a uniform thickness for providing good quality images.

According to the developing apparatus of the invention, the layer-thickness regulating member itself is capable of absorbing the vibrational energy thereby to control the vibration thereof. This is effective to prevent drawbacks such as a toner layer formed in inconsistent thicknesses due to the vibration produced in the layer-thickness regulating member; images of lowered quality due to density variations, unwanted tone variations, fogging, and contamination; the contaminated interior of the image forming apparatus with scattered toner and the like. Thus, a stable forming of good quality images is ensured.

It is rather difficult for a layer-thickness regulating member composed of a single element to simultaneously meet both of a toner-layer forming condition for forming a toner layer having a predetermined quantity of toner charge and a predetermined thickness, and a vibration damping condition for effectively controlling the vibration of the layer-thickness regulating member. In this respect, the developing apparatus of the invention has adopted a separated-function structure for the layer-thickness regulating member, which employs a member for forming the toner layer (layer forming member) and a member for controlling the vibration (vibration damping member) in combination. Thus, the developing apparatus of the invention secures a degree of freedom of selection of the material for and the construction of the layer-thickness regulating member while providing the forming of a favorable toner layer and a positive vibration damping effect.

According to the developing apparatus of the invention, the layer-thickness regulating member adopts the separated-function structure employing the layer forming member and the vibration damping member in combination, thereby satisfying both the toner-layer forming condition and the vibration damping condition and also permitting a greater freedom of selection of the material therefor and the construction thereof. Thus is ensured a more stable image forming process.

The developing apparatus of the invention is further characterized in that the vibration damping member is made of a metal.

The developing apparatus of the invention normally employs a layer-thickness regulating member composed of a cantilevered flat metal spring having a thickness of about 50 to 500 $\mu$m for simplification of the construction thereof, which is required for accomplishing a higher definition of resultant images and reduced size and costs of the device. As a more specific example of the layer-thickness regulating member of the cantilevered structure, there has been known a layer-thickness regulating member arranged to have a free end thereof abutted against place upstream along a direction of rotation of the developer carrier for forming a stable toner layer under a low abutment pressure (hereinafter referred to as "counter abutment"), the counter abutment construction effective to prevent the degradation of the toner due to the abutment pressure, toner fixing to a peripheral portion of the layer-thickness regulating member and the like. In the case of the counter abutment structure, however, the vibration such as stick slip is more likely to occur because of synergy between the cantilevered structure and the counter abutment of the layer-thickness regulating member. In addition, having no capability of absorbing the vibrational energy produced at a sliding portion and the like, the layer-thickness regulating member is susceptible to the vibration.

According to the developing apparatus of the invention, the layer-thickness regulating member employs the flat spring formed of a metal capable of damping the vibration and thus, positively controls the vibration thereof.

According to the developing apparatus of the invention, the layer-thickness regulating member of the flat spring structure, which is susceptible to the vibration, can assuredly control the vibration thereof by virtue of employing the metal capable of damping the vibration. Furthermore, an effective layer-thickness regulating member for controlling the vibration thereof may also be formed of only a metal having a vibration damping effect. This contributes to a reduced size and cost of the device.

The developing apparatus of the invention is further characterized in that the layer forming member has an upstream end portion protruding from the vibration damping member.

Behind the invention is a fact that the recent trend toward higher definitions of images involves reduction of the particle size of toner (10 $\mu$m or less). Production of favorable images of high definitions requires not only the toner of a reduced particle size but also the toner layer reduced in thickness. Even if the layer-thickness regulating member adopts the structure in which the free end portion thereof abuts against place upstream along the direction of rotation of the developer carrier (hereinafter referred to simply as "upstream") for stable forming of the toner layer under a lower abutment pressure than other structures, the layer-thickness regulating member still suffers an excessive abutment pressure. As a result, the layer-thickness regulating member is more susceptible to the vibration and also entails drawbacks such as the degradation of the toner, toner fixing to the peripheral portion of the abutment portion, wear-out deterioration of the abutment portion and increase in the driving torque of the developer carrier.

According to the developing apparatus of the invention, the layer forming member small in thickness (100 $\mu$m or less) has an upstream edge portion slightly protruding (1 mm or less) to the vibration damping member. This is effective to decrease a toner-layer parting force produced during the forming of the thin toner layer, thus ensuring the stable forming of the toner layer under a low abutment pressure.

According to the developing apparatus of the invention, the layer forming member has its upstream edge portion slightly protruding (1 mm or less) to the vibration damping member thereby reducing the toner-layer parting force produced during the forming of the toner layer. As a result, the toner degradation, the toner fixing and the wear-out deterioration of the regulating surface can be decreased so that the stable forming of images is ensured over an extended period of time.

The developing apparatus of the invention is further characterized in that the vibration damping member is made of a rubber material.

According to the developing apparatus of the invention, the vibration damping member is formed of a rubber material featuring a small impact resilience for effective damping of the vibration, providing a stable abutment pressure by virtue of its modulus of elasticity which is not changed by temperature, and resisting the permanent deformation thereof. Thus is ensured a stable vibration damping effect over an extended period of time.

The developing apparatus of the invention is further characterized in that the vibration damping member is made of a soft foam material.

According to the developing apparatus of the invention, by employing for the vibration damping member the soft foam material having a smaller impact resilience and modulus of elasticity than the solid rubber material, there is prevented an unwanted increase in the abutment pressure associated with a required thickness of the vibration damping member for attaining the vibration damping effect.

The developing apparatus of the invention is further characterized in that the soft foam material is of an independent-cellular structure.

According to the developing apparatus of the invention, by forming the vibration damping member of the foam material of the independent-cellular structure, there is prevented a reduced layer forming capability resulting from the toner entering the cells to be solidified therein or a layer forming failure resulting from a reduced vibration damping capability.

The developing apparatus of the invention is further characterized in that at least a part of the vibration damping member is made of a fluoro rubber foam.

According to the developing apparatus of the invention, the vibration damping effect of the layer-thickness regulating member can be increased by forming the vibration damping member of the fluoro rubber foam presenting an excellent vibration damping effect because of its particularly small restitution coefficient of 0.16.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein at least one segment of the sealing member is made of a soft foam material of an independent-cellular structure which is capable of absorbing vibrational energy.

In the developing apparatus of the invention, at sealing portions at opposite ends of the layer-thickness regulating member which are pressed against the sealing members for preventing the toner from being scattered or spilled therefrom, there also occurs a toner sealing failure due to the vibration of the layer-thickness regulating member associated with the rotation of the developer carrier, similarly to the aforesaid aspect of the invention. This toner sealing failure causes some toner to be scattered or spilled, resulting in drawbacks such as the contamination of resultant images or the interior of the apparatus, an increased toner consumption and the like.

The sealing portions of the layer-thickness regulating member are particularly susceptible to the vibration because the sealing portions define the edge portions of the layer-thickness regulating member and the layer-thickness regulating member tends to be in direct contact with a surface of the rotating developer carrier with no toner interposed therebetween, the toner preliminarily removed by the sealing member upstream of the sealing portions. In addition, there is a fear that the sealing portions themselves may produce the vibration which causes a toner leakage from the sealing portions or which is transferred to the layer-thickness regulating member thereby to drive the regulating member into vibration.

According to the developing apparatus of the invention, the sealing members are adapted to absorb the vibrational energy for controlling the vibration of the layer-thickness regulating member or of the sealing members, thereby to prevent the toner sealing failure.

According to the developing apparatus of the invention, the vibration of the edge portions of the layer-thickness regulating member pressed against the sealing members and of the sealing members is controlled thereby to prevent some toner from being spilled from the edge portions of the layer-thickness regulating member and from the vicinities of the sealing members and to prevent the layer-thickness regulating member from being driven into vibration. This is effective to prevent images of lowered quality due to fogs, contamination or the like, an abnormal toner consumption, contamination of the interior of the apparatus, all of which result from the toner sealing failure.

According to the developing apparatus of the invention, the use of the soft polyurethane foam material of the independent-cellular structure for the sealing members provides an effective control of the vibration of the edge portions of the layer-thickness regulating member or of the sealing members and also prevents the sealing members from being solidified with the toner. Thus are accomplished stable effects for toner sealing and vibration damping, which effects will not decay with time.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein at least one segment of the sealing member is made of a fluoro rubber capable of absorbing vibrational energy.

According to the developing apparatus of the invention, the sealing members at the lateral sides of the layer-thickness regulating member are formed of the fluoro rubber which is effective to prevent the toner sealing failure caused by the toner entering the cells of the material to be solidified therein and which is excellent in slidability with a small friction coefficient. Thus is accomplished an excellent vibration damping effect and a stable toner sealing effect, which will not decay with time.

According to the developing apparatus of the invention, the use of the fluoro rubber for the sealing members provides the prevention of damages on sliding surfaces of the developer carrier and the sealing members, thus offering stable effects for the toner sealing and vibration damping which will not decay with time.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein the layer-thickness regulating member includes a layer forming member for forming the toner layer and a vibration damping member configured to have a greater width than the layer forming member, for absorbing vibrational energy.

A fear exists with the aforementioned developing apparatus of the invention that in a case where toner of a smaller particle size (10 $\mu$m or less) is used for producing images of higher definitions, an arrangement in which the vibration damping member on a back side of the layer-thickness regulating member and the sealing members at the opposite ends of the developer carrier are simply in contact relation may detrimentally allow some toner to be spilled through a minute gap in an abutment portion therebetween.

According to the developing apparatus of the invention, the vibration damping member on the back side of the layer-thickness regulating member has a greater width than the layer-thickness regulating member, thereby offering a more positive toner sealing capability.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein the sealing member includes a plurality of sealing segments of different materials which segments are alighned in a width direction of the toner carrier, and wherein at least one segment of the sealing member is capable of absorbing vibrational energy.

According to the developing apparatus of the invention, the sealing member includes different sealing segments aligned in the width direction of the developer carrier in order to prevent the toner leakage through the minute gap in the abutment portion between the vibration damping member on the back side of the layer-thickness regulating member and the sealing members at the opposite ends of the developer carrier, the toner having a reduced particle size (10 $\mu$m or less) for the production of images of high definition. Specifically, one of the different sealing segments of the sealing member acts to control the vibration at the end of the layer-thickness regulating member and to prevent the toner leakage, whereas the other sealing segment thereof acts to wipe out some toner having failed to be blocked. Thus, a movement of the toner to the opposite ends of the developer carrier is positively prevented for the vibration control and also for the avoidance of drawbacks caused by the scattered toner, such as the contaminated interior of the apparatus, the increased toner consumption and the like.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein the sealing member includes a plurality of sealing segments of different materials which segments are aligned in a circumferential direction of the toner carrier, and wherein at least one segment of the sealing member is capable of absorbing vibrational energy.

The developing apparatus of the invention is directed to prevent the developer leakage through the minute gap in the abutment portion between the vibration damping member on the back side of the layer-thickness regulating member and the sealing members at the opposite ends of the developer carrier in a case where the developer has a small particle size (10 $\mu$m or less) for producing high-definition images. Specifically, the sealing member includes sealing segments of different materials arranged circumferentially of the developer carrier, one of which sealing segments acts to damp the vibration at either of the opposite ends of the layer-thickness regulating member as prohibiting the developer leakage therefrom whereas the other of which segments acts to wipe out some toner having failed to be blocked. Thus, the toner is positively prevented from moving to the opposite ends of the developer carrier, so that the occurrence of vibration and other drawbacks caused by scattered developer such as a contaminated interior of the apparatus, an increased developer consumption and the like may be avoided.

The developing apparatus of the invention is further characterized in that at least one segment of the sealing member is formed of a bristled textile fabric or fibrous material.

According to the developing apparatus of the invention, the outer sealing segment of the elastic sealing segments of different materials is formed of the bristled textile fabric or fibrous material for more effectively wiping out some toner having failed to be blocked by the sealing segment pressed against the layer-thickness regulating member as acting to damp the vibration of the layer-thickness regulating member. This provides more positive prevention of the movement of the toner to the opposite ends of the layer-thickness regulating member, thus minimizing the toner scattering resulting in the contamination of the interior of the apparatus or the increased toner consumption.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier;

a sealing member pressed against the layer-thickness regulating member; and a supplier for supplying one-component toner to the toner carrier, wherein a part of the sealing member is comprised of a vibration damping member disposed on a back side of the layer-thickness regulating member for absorbing vibrational energy, and wherein the vibration damping member has a smaller modulus of elasticity than the sealing member excluding the portion defined by the vibration damping member.

According to the developing apparatus of the invention, the vibration damping member on the back side of the layer-thickness regulating member has a smaller modulus of elasticity than the sealing members at the opposite ends of the developer carrier such that the vibration damping member on the back side of the layer-thickness regulating member is effectively compressed for more effectively damping the vibration at the opposite ends of the layer-thickness regulating member. At the same time, the gap in the abutment portion therebetween is eliminated thereby to increase the toner sealing capability of the sealing member and thus, the toner leakage from the developing apparatus is prevented.

The invention provides a developing apparatus comprising:

a toner carrier for transferring toner to a development position;

a layer-thickness regulating member for forming a toner layer having a predetermined thickness on the toner carrier by making contact in a leading edge or a surface of a vicinity of the leading edge with the toner carrier; and a supplier for supplying one-component toner to the toner carrier, wherein at least a part of the sealing member is made of a fluoro rubber foam capable of absorbing vibrational energy.

According to the developing apparatus of the invention, the sealing member or one of the plural sealing segments of the sealing member is formed of the fluoro rubber foam presenting an excellent vibration damping effect because of its particularly small restitution coefficient of 0.16 and also a good silidability, thereby increasing the effect for damping the vibration at the opposite ends of the layer-thickness regulating member. At the same time, the gap in the abutment portion is eliminated for enhancing the toner sealing capability of the sealing members so that the toner leakage from the developing apparatus is prevented.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
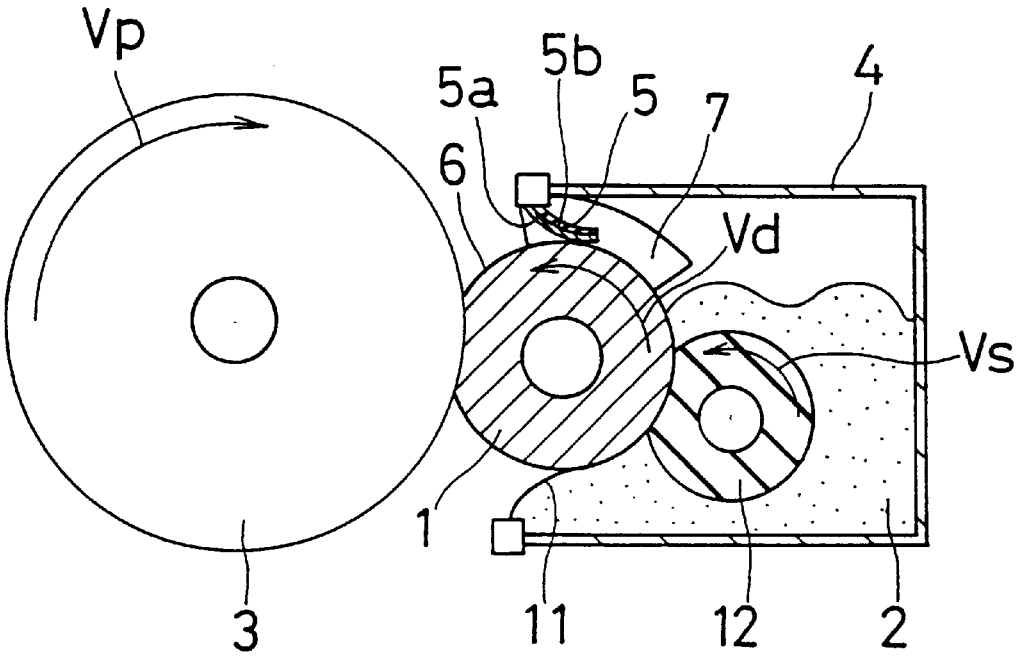
FIG. 1 is a sectional view for illustrating a construction of a developing apparatus according to an embodiment of the invention.

Now referring to the drawings, preferred embodiments of the invention are described below.

According to the developing apparatus of the invention, the layer-thickness regulating member is adapted to absorb the vibrational energy for controlling the vibration thereof and hence, a toner layer may be formed in a uniform thickness thereby to permit the production of good quality images.

The developing apparatus according to the invention is characterized in that the layer-thickness regulating member is composed of a combination of a member for forming the toner layer and a member for absorbing the vibrational energy.

EXAMPLE 1

Figure 2:
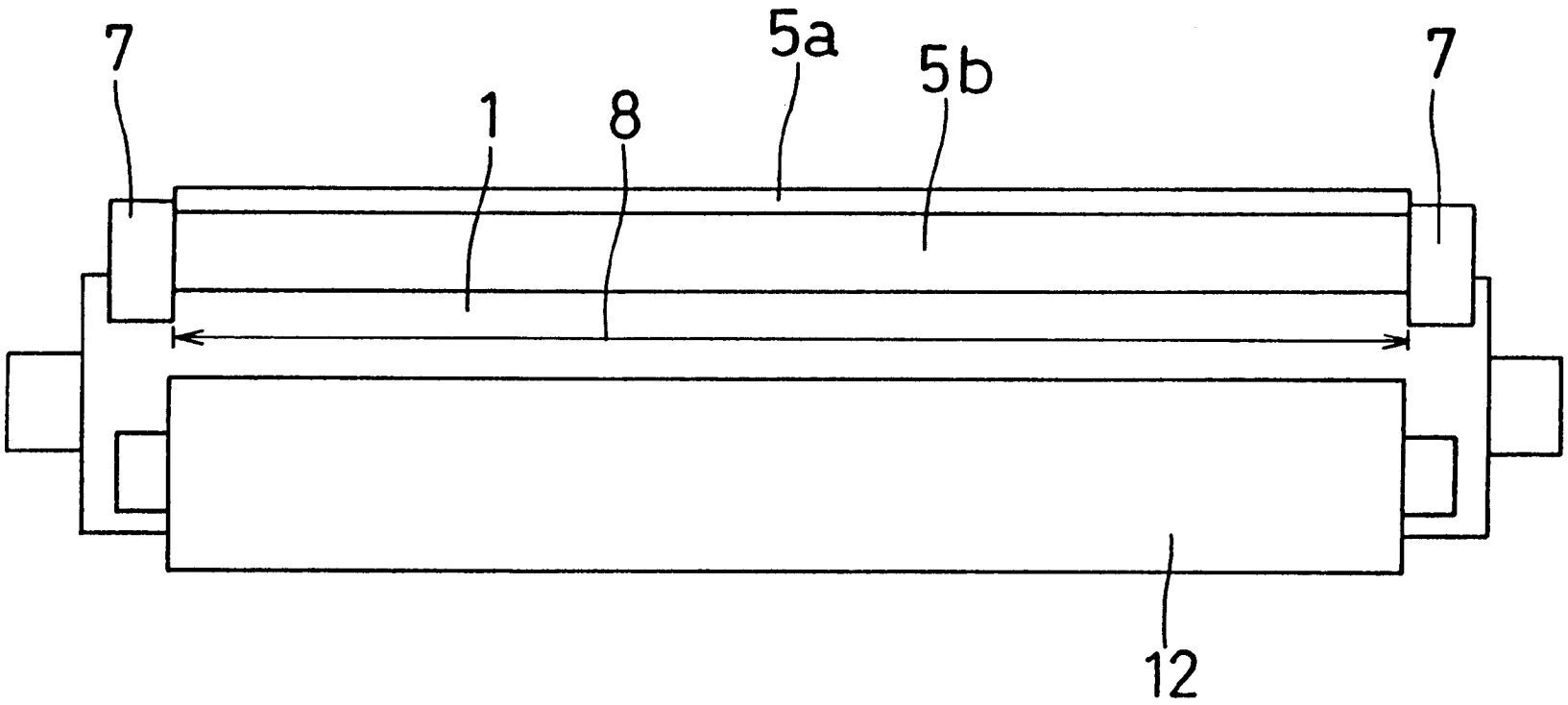
FIG. 2 is a plan view for illustrating the arrangement of the developing apparatus according to the embodiment of the invention.

FIG. 1 is a schematic diagram for illustrating a developing apparatus of the invention applied to an electrophotographic laser printer. FIG. 2 is a plan view of this developing apparatus whereas FIG. 3 is a perspective view for illustrating a principal portion thereof.

Referring to FIG. 1, there are provided a developer carrier 1 shaped like a column, and a toner case 4 for continuously supplying a suitable amount of toner 2 to a surface of the developer carrier. This example employs the developer carrier 1 formed of a electrically conductive rubber material and the toner 2 of a non-magnetic one-component type having a negative charge, a high resistance and a mean particle size of about 7.5 $\mu$m. The developer carrier 1 is rotatably supported at opposite ends thereof and rotated at a predetermined velocity for transporting the toner 2 from the toner case 4 as holding the toner on its surface.

In the toner case 4, a layer-thickness regulating member 5 is disposed at place downstream along a direction of the rotation of the developer carrier 1. The layer-thickness regulating member is adapted to control the vibration thereof by way of a combination of a layer forming member 5*a* and a vibration damping member 5*b* resting on a back side of the layer forming member 5*a*. Specifically, the vibration damping member 5*b* serves to prevent an occurrence of the vibration by absorbing therein vibrational energy to be received by the layer-thickness regulating member, the vibrational energy produced by change with time in an abutment state of the layer-thickness regulating member, stick slip associated with the rotation of the developer carrier, vibration transferred from a motor as a drive source, foreign matter entered in or deposited on an abutment portion and the like. This is effective to prevent drawbacks resulting from the vibration of the layer-thickness regulating member 5, the vibration causing the toner to be scattered or spilled from a developer chamber thus entailing contamination of images, increase in the toner consumption and contamination of an interior of the image forming apparatus.

Figure 3:
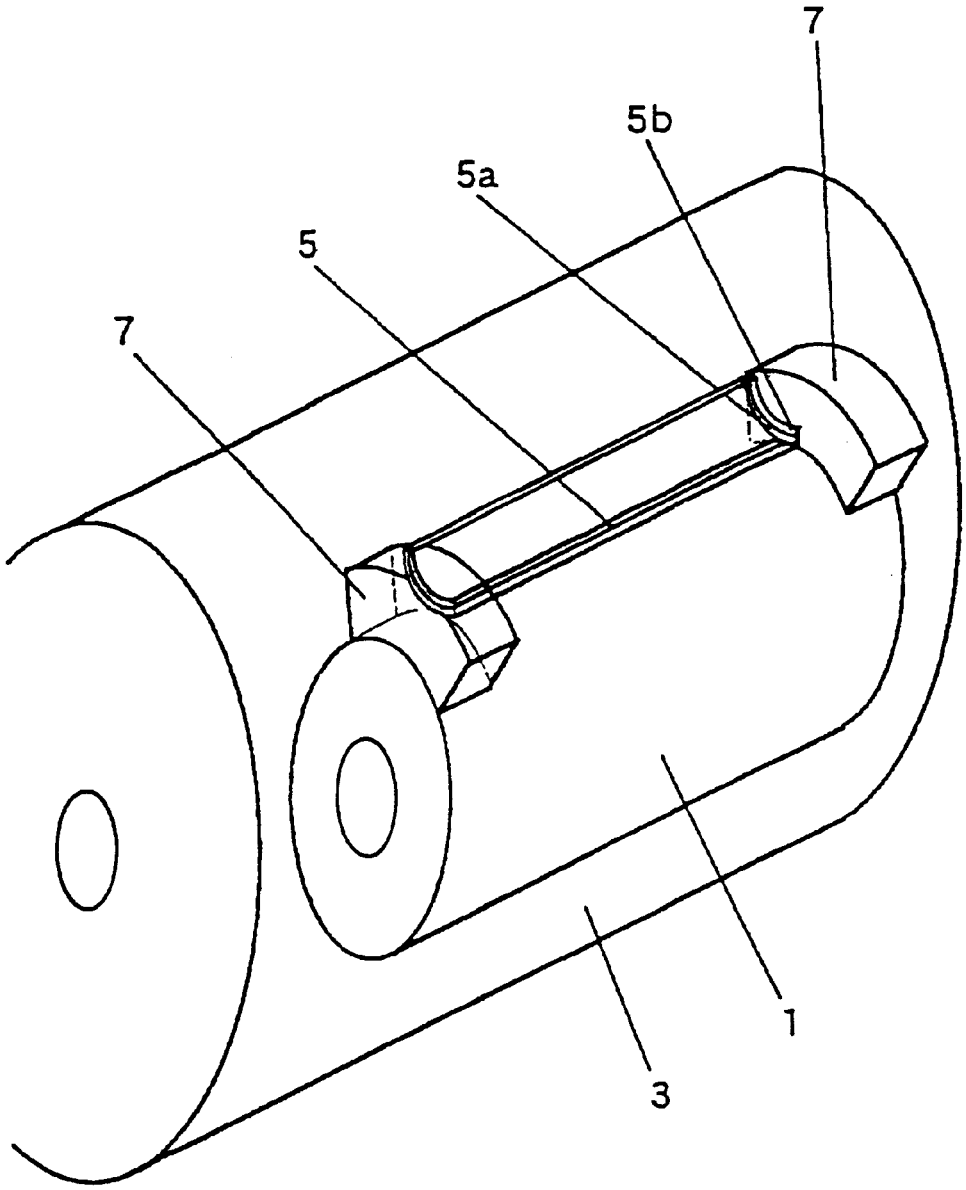
FIG. 3 is a perspective view for illustrating the arrangement of the developing apparatus according to the embodiment of the invention.

As seen in FIGS. 2 and 3, the layer-thickness regulating member 5 is arranged such that opposite end portions of an upstream surface of the layer-thickness regulating member 5 are out of contact with sealing members 7 at a leading edge or a leading edges of the surface. The sealing members 7 are each formed of an elastic member effective to damp the vibration of the layer-thickness regulating member 5 at the opposite end portions thereof. The vibration damping member 5*b* on the back side of the layer-thickness regulating member 5 has its lateral end faces pressed against respective lateral end faces of the sealing members 7 at the opposite end portions of the developer carrier 1, thereby to seal against leakage of the toner 2.

The layer-thickness regulating member is susceptible to the vibration because the layer-thickness regulating member is a leading edge and tends to be in direct abutment against a surface of the rotating developer carrier with no toner interposed tehrebetween, the toner preliminarily removed by the sealing members upstream of the layer-thickness regulating member. However, the above arrangement permits the layer-thickness regulating or sealing member to absorb the vibrational energy so that the vibration of the layer-thickness regulating member may be controlled.

In this case, three types of rollers may have the following preferred rotational velocities, for example.

Circumferential velocity of image bearing member 3 (photoconductor) Vp=25–300 mm/sec Circumferential velocity of developer roller 1 (developer carrier) Vd=25–450 mm/sec Circumferential velocity ratio Vd/Vp=1–2

Circumferential velocity of supply roller 12 Vs=25–450 mm/sec

Circumferential velocity ratio Vs/Vd=0.5–2

Contact depth of supply roller 12: 0.2–2 mm

More specifically, the following velocities are preferred.

(1)

Circumferential velocity of image bearing member 3 (photoconductor) Vp=175 mm/sec Circumferential velocity of developer roller 1 (developer carrier) Vd=228 mm/sec Circumferential velocity ratio Vd/Vp=1.3
Circumferential velocity of supply roller 12 Vs=205 mm/sec
Circumferential velocity ratio Vs/Vd=0.9
Contact depth of supply roller 12: 0.7–1 mm
(2)
Circumferential velocity of image bearing member 3 (photoconductor) Vp=50 mm/sec
Circumferential velocity of developer roller 1 (developer carrier) Vd=80 mm/sec
Circumferential velocity ratio Vd/Vp=1.6
Circumferential velocity of supply roller 12 Vs=40 mm/sec
Circumferential velocity ratio Vs/Vd=0.5
Contact depth of supply roller 12: 0.5 mm At opposite-end sealing portions of the layer-thickness regulating member 5, the opposite end portions of the layer-thickness regulating member 5 are not directly pressed from the back side thereof by the sealing members 7 at the opposite ends of the developer carrier 1. Therefore, the developer carrier 1 does not suffer a local damage due to a back sealing pressure. The prevention of the local damage on the developer carrier 1 leads to the prevention of drawbacks resulting therefrom, such as an oversupply of the toner, contamination of the interior of the image forming apparatus with scattered toner, an increased toner consumption and the like. The layer-thickness regulating member 5 serves to regulate an amount of toner 2 supplied from the toner case 4 to the surface of the developer carrier 1, thereby forming a thin toner layer 6.

According to this example, the layer-thickness regulating member 5 has a construction In which a 3-mm thick, flexible soft polyurethane foam material of an independent-cellular structure is bonded with a double-sided adhesive tape to the back side of the layer forming member 5*a*, such as formed of a 0.1-mm thick stainless steel sheet. The polyurethane foam material has, for example, a foaming density of 35 cells/25 mm, an impact resilience of 40% and a JIS hardness of 11 (Kg). The layer-thickness regulating member 5 has one end thereof fixed to the toner case 4.

The vibration damping member is formed of a solid rubber material. Alternatively, any flexible material capable of damping the vibration, such as a soft foam material of a continuous-cellular structure, maybe employed unless a fear for solidification of the toner exists. Through elasticity inherent thereto, the layer-thickness regulating member 5 is pressed against the developer carrier 1 in a manner such that a length between the fixed portion to the toner case 4 and a contact portion with the developer carrier 1 is 10 mm and an amount of deflection is 1 mm.

A bias voltage having a potential difference of −150 V from a potential of the developer carrier 1 is applied to the layer forming member 5*a* while the layer-thickness regulating member 5 is pressed against the developer carrier 1 under a consistent pressure, whereby the thin toner layer 6 can attain a stable layer thickness and quantity of charge. In the case of a low processing speed, the bias voltage for layer-thickness regulation may be equal to that of the developer carrier or at floating potential.

The developer carrier 1 is provided at the opposite ends thereof a pair of sealing members 7 for prevention of oversupply of the toner 2 to the opposite end portions thereof, the sealing member having elasticity and formed of a material capable of absorbing the vibrational energy. Each sealing member 7 has its inside edge positioned between a lateral edge of the developer carrier 1 and a lateral edge of an electrostatic-latent-image region 8 on the image bearing member 3. The sealing members 7 are pressed against a surface of the developer carrier 1 while having a respective lateral end portions thereof contacted under a given pressure with the opposite end portions of the vibration damping member 5*b* on the back side of the layer-thickness regulating member 5.

The sealing member 7 has a construction in which a 10-mm thick polyurethane foam of the same material with that of the layer-thickness regulating member 5 is bonded by the double-sided adhesive tape to a bristled textile fabric with about 2-mm long bristles, the textile fabric having a good absorptivity of the vibrational energy (in other words, good damping effect or small impact resilience) and a suitable degree of elasticity. The sealing member 7, as a whole, has an elasticity substantially equal to a polyurethane foam with an impact resilience of about 0.4 and is retained by the toner case 4 at a back side thereof.

The sealing member 7 may be formed of any other material than the bristled textile fabric, that has a suitable degree of elasticity and vibration damping effect, the suitable degree of elasticity negating the need for a great pressing force for sealing, and that do not solidify with the toner. Examples of the usable material include a felt, a solid rubber (JIS-A rubber hardness of about 70 or less), a foam (JIS hardness of 60 Kg or less) and the like. Since the sealing member is in sliding contact with the developer roller, such a material preferably has a small friction coefficient of 0.6 or less, and a sufficient mechanical strength to resist breakage, such as mars and tears, over an extended period of time. Additionally, a sliding member such as a Teflon sheet may preferably be laminated to the surface of the sealing member.

There are known the solid rubbers having the following properties.

| | JIS hardness | JIS impact resilience % |
|---|---|---|
| Natural rubber | 30–100 | 70–90 |
| Styrene-butadiene rubber (SBR) | 10–100 | 60–80 |
| Polyisopropylene rubber (IR) | 10–100 | 70–90 |
| Polybutadiene rubber (BR) | 10–100 | 70–95 |
| Polyethylene-propylene rubber (EPR) | 20–90 | 50–80 |
| Butyl rubber | 10–95 | 20–50 |
| Neoprene | 10–95 | 50–80 |
| Acrylonitrile-butadiene rubber (NBR) | 10–100 | 20–55 |

There are known the foams having the following properties.

| | JIS impact resilience % |
|---|---|
| Polyethylene foams | 2–73 |
| Polyurethane foams | 15–55 |

The thin toner layer 6 formed on the developer carrier 1 is transferred to place where the developer carrier 1 comes in contact with or close to the image bearing member 3 composed of a negatively charged OPC, thereby to develop an electrostatic latent image 8 on the image bearing member 3.

In this example, the developer carrier 1 is applied with a developing bias voltage of the same negative polarity with the charged thin toner layer 6 for reversely developing the electrostatic latent image 8 formed on the image bearing member 3 through a potential difference from that of the electrostatic latent image. The supply roller 12 formed of a electrically conductive polyurethane foam is applied with a bias voltage of a greater negative value than the developing bias voltage. The supply roller 12 makes contact with the developer carrier 1 at a predetermined contact depth while moving in an opposite direction to the developer carrier 1, thereby supplying the toner 2 to the developer carrier 1 via contact surfaces. At the same time, the supply roller 12 removes the toner 2 remaining on the developer carrier 1 after a development process. In the case of a slow processing speed, the supply roller 12 is not applied with the supply bias voltage but at a floating potential. Otherwise, the supply roller 12 may be formed of an electrically insulative polyurathane foam material. Indicated at 11 is a polyester film sheet for preventing the toner from being spilled from a lower portion of an opening of the developer chamber.

EXAMPLE 2

Figure 4:
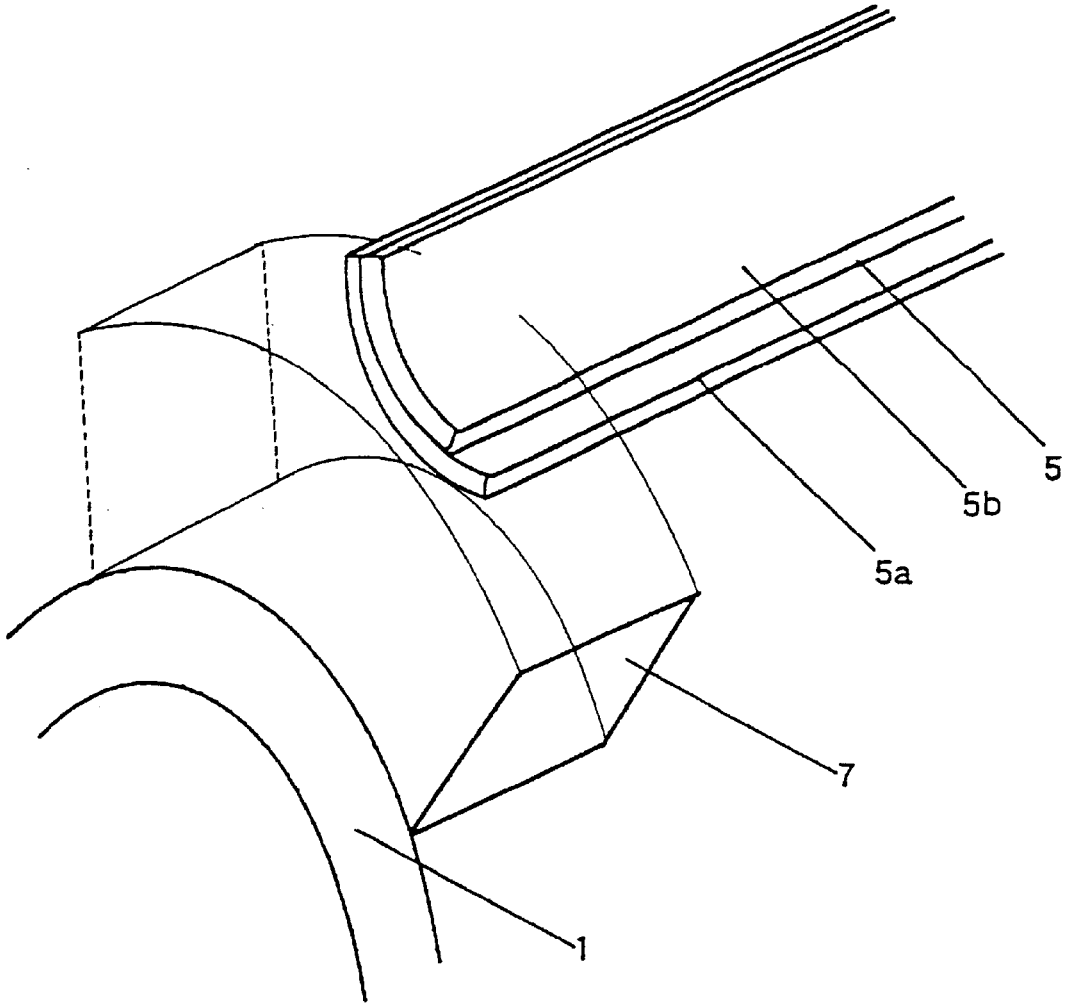
FIG. 4 is a perspective view for illustrating an arrangement of the developing apparatus according to one embodiment of the invention.

FIG. 4 is a perspective view for illustrating an arrangement in which the layer forming member 5*a* and vibration damping member 5*b* of Example 1 are bonded together with the layer forming member 5*a* protruding upstream from an end of the vibration damping member 5*a* by 1 mm. The layer-thickness regulating member 5 abuts against the developer carrier 1 at a leading edge of the layer forming member 5*a*, thereby reducing a parting force exerted on a continuous toner layer and forming a stable thin toner layer (about 15 μm thick).

Furthermore, an elastic force of the vibration damping member 5*b* can be utilized for forming the toner layer so that the layer forming member may have a smaller thickness than the layer-thickness regulating member composed of a single metal. This also advantageously contributes to the reduction of the parting force exerted on the continuous toner layer.

EXAMPLE 3

A layer forming member formed of a vibration-damping metal material is employed as the layer forming member 5*a* of the layer-thickness regulating member 5 of Example 1, the vibration-damping metal excellent in absorbing the vibrational energy therein. This permits the layer-thickness regulating member 5 to be formed of a single element, thus accomplishing the simplification of the mechanism.

This example employs a layer-thickness regulating member 5 formed of a 100-μm thick vibration-damping metal sheet, such as of a ferromagnetic high damping alloy, thereby achieving an excellent vibration damping effect and a stable forming of the thin toner layer, although the regulating member is composed of a single element. Examples of a vibration-damping metal suitably employed by the invention include ferromagnetic high damping alloys, twin crystal high damping alloys and the like.

The high damping alloy means a metal which has such a great internal friction as to convert elastic energy produced by the vibration into heat energy, thus being capable of quickly damping the vibration.

If it is required, the layer-thickness regulating member may be composed of the layer forming member of a vibration-damping metal and the vibration damping member of a rubber or foam in combination.

EXAMPLE 4

Figure 5:
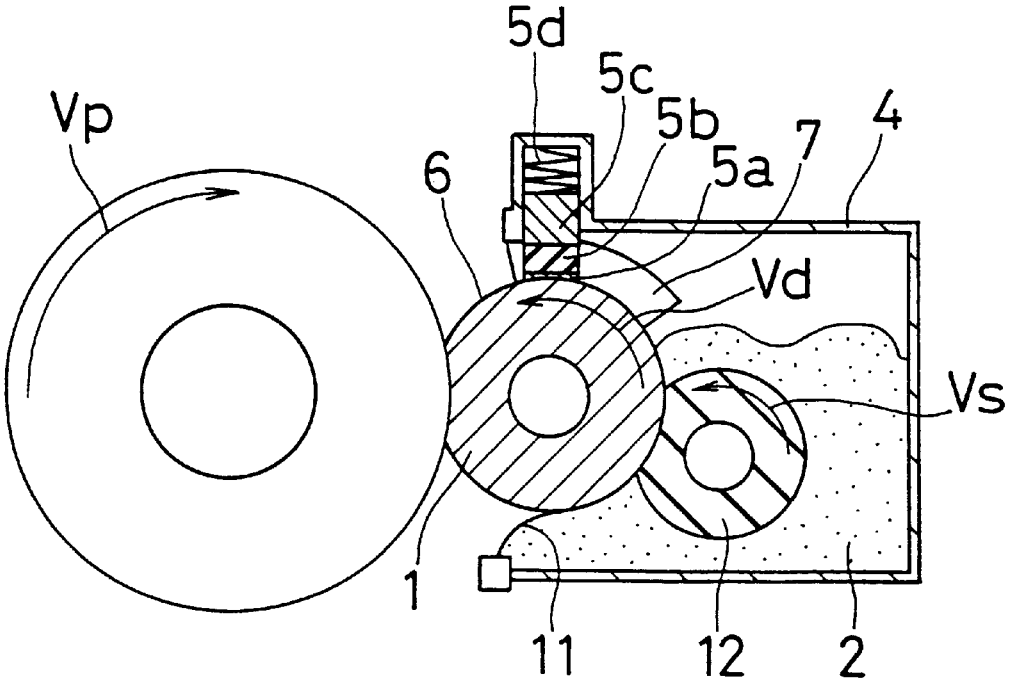
FIG. 5 is a sectional view for illustrating a construction of the developing apparatus according to one embodiment of the invention.

FIG. 5 diagrammatically illustrates an exemplary arrangement in which the normal load system is applied to the layer-thickness regulating member 5 of Example 1. This layer-thickness regulating member 5 includes a supporting member 5*c* formed of a 10-mm thick stainless steel block which has a rigidity to receive a predetermined pressing force of a spring 5*d* and is vertically movable, a 3-mm thick vibration damping member 5*b* formed of butyl rubber which is excellent in the vibration absorptivity with an impact resilience of not greater than 0.5 and is mechanically stable, and a layer forming member 5*a* formed of a 50-μm thick stainless steel, the supporting member, the vibration damping member and the layer forming member bonded to each other in vertical positional relation. In the normal load system, the layer-thickness regulating member of the invention presents a good vibration damping effect, thus providing the stable layer forming.

Examples of a rubber material having the vibration damping effect include butyl rubber, acrylonitril-butadiene rubber (NBR), neoprene, styrene-butadiene rubber (SBR), polyethylene-propylene rubber (EPR), fluoro rubber and the like. Preferably, such materials have impact resiliences of not greater than 0.7. In this case, the greater the vibration damping effect, the more preferable the rubber material. In order to meet a goal of reducing by half the vibrational energy in one vibration cycle, an impact resilience of not greater than 0.7 is prerequisite.

An impact resilience of not greater than 0.5 can be achieved by using a soft foam material for the vibration damping member and thus, a more excellent vibration damping effect may be offered.

It is to be noted that these vibration damping materials should not be limited to this example of the invention and is widely applicable to the cantilevered construction of the invention, the sealing member with the vibration damping effect, which will be described later, and the like.

EXAMPLE 5

Figure 6:
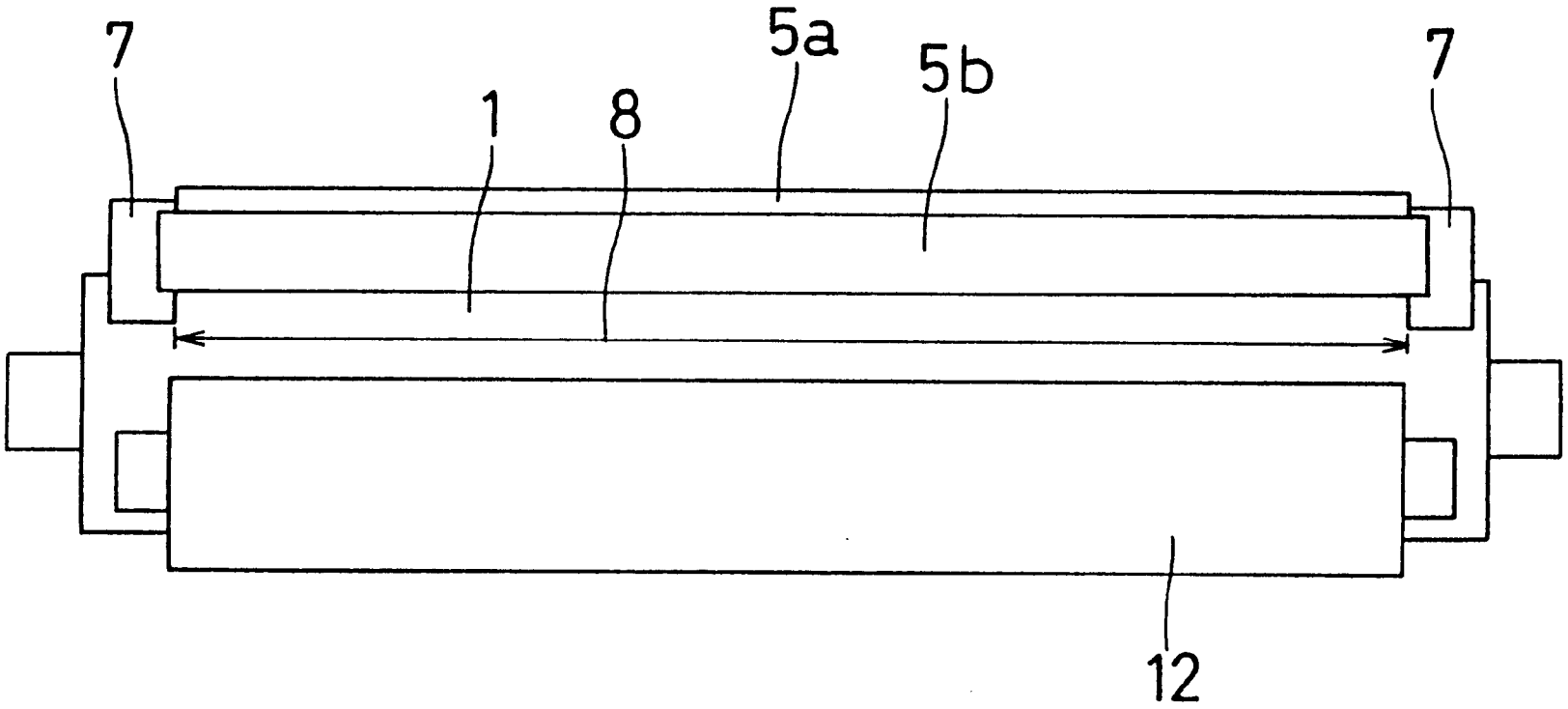
FIG. 6 is a plan view for illustrating an arrangement of the developing apparatus according to one embodiment of the invention.

FIG. 6 diagrammatically illustrates a modified arrangement of the layer-thickness regulating member of FIG. 2 wherein the vibration damping member 5*b* on the back side of the layer-thickness regulating member 5 has a widthwise length slightly greater than the electrostatic latent image region 8. This provides a more effective increase of the contact pressure between the vibration damping member and the sealing members 7 at the opposite ends of the developer carrier 1.

By adopting the arrangement shown in FIG. 6, the sealing members 7 may be further increased in the capability of sealing the toner 2.

EXAMPLE 6

Figure 7:
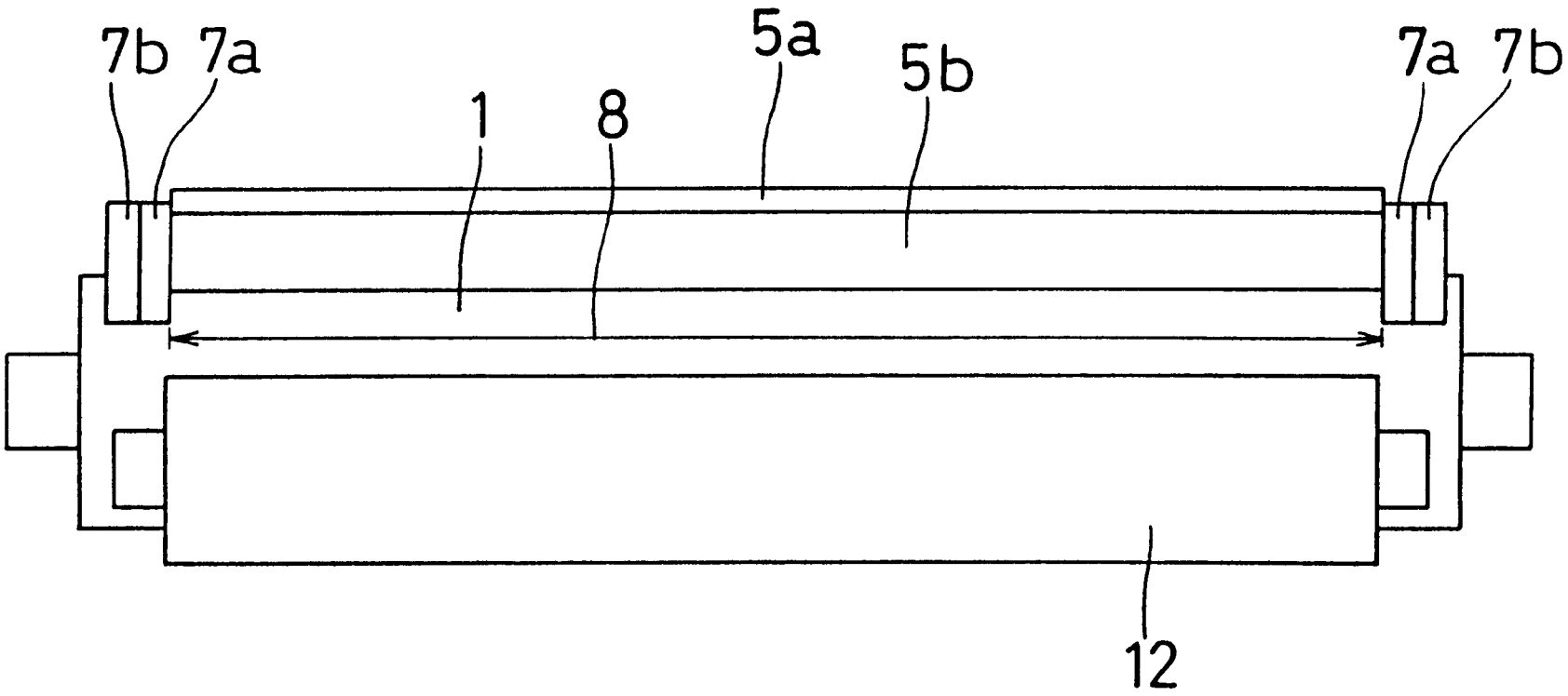
FIG. 7 is a plan view for illustrating an arrangement of the developing apparatus according to one embodiment of the invention.

FIG. 7 schematically illustrates a developing apparatus wherein the sealing member 7 of FIG. 2 is divided into sealing segments 7*a* and 7*b* of different materials which are arranged laterally of the developer carrier 1. The sealing segments 7*a* are disposed on respective inner sides of axially opposite ends of the developer carrier 1 so as to be pressed against the opposite ends of the layer-thickness regulating member 5. The sealing segments 7*a* permit a wider selection of materials employed for the vibration damping.

In this example, the sealing segment 7*a* at the axially inner side of the developer carrier 1 is formed of a solid-state fluoro rubber whereas the sealing segment 7*b* at the outer side is formed of a fluoro rubber foam of the independent-cellular structure. This arrangement prevents damages on the sealing members due to the sealing action or the sliding contact with the developer carrier 1 as well as an adverse effect of toner solidified therein.

The fluoro rubber foam employed by this example has a small impact resilience of 0.16 and presents an excellent vibration damping effect when applied to the inside sealing segment 7*a* and the vibration damping member 5*b*. A skin layer may be formed on a surface of the fluoro rubber foam. The toner 2 moving to the opposite ends of the developer carrier 1 is principally blocked by the sealing segments 7*a* but some toner 2 having failed to be blocked by the elastic sealing segments 7*a* is wiped out by the sealing segments 7*b* having a higher sealing effect.

The arrangement shown in FIG. 7 provides a more positive prevention of the oversupply of toner 2 to the developer carrier 1, thus ensuring the prevention of the contamination of the interior of the apparatus with scattered toner and the increased toner consumption.

Alternatively, the sealing segment 7*b* may be formed of polyurethane foam. Otherwise, the use of an elastic bristled textile fabric or fibers for the sealing segment 7*b* further increases the effect for wiping out the toner. Thus, the contamination of the interior of the apparatus with scattered toner, the increased toner consumption and the like are more positively prevented.

EXAMPLE 7

FIG. 6 diagrammatically illustrates a developing apparatus wherein the vibration damping member 5*b* on the back side of the layer-thickness regulating member 5 of FIG. 2 has a widthwise length slightly greater than the electrostatic latent image region 8 thereby to effectively increase the contact pressure between the vibration damping member 5*b* and the elastic sealing members 7 at the opposite ends of the developer carrier 1.

By adopting the arrangement shown in FIG. 6, the elastic sealing members 7 may be further increased in the capability of sealing the toner 2.

EXAMPLE 8

Figure 8:
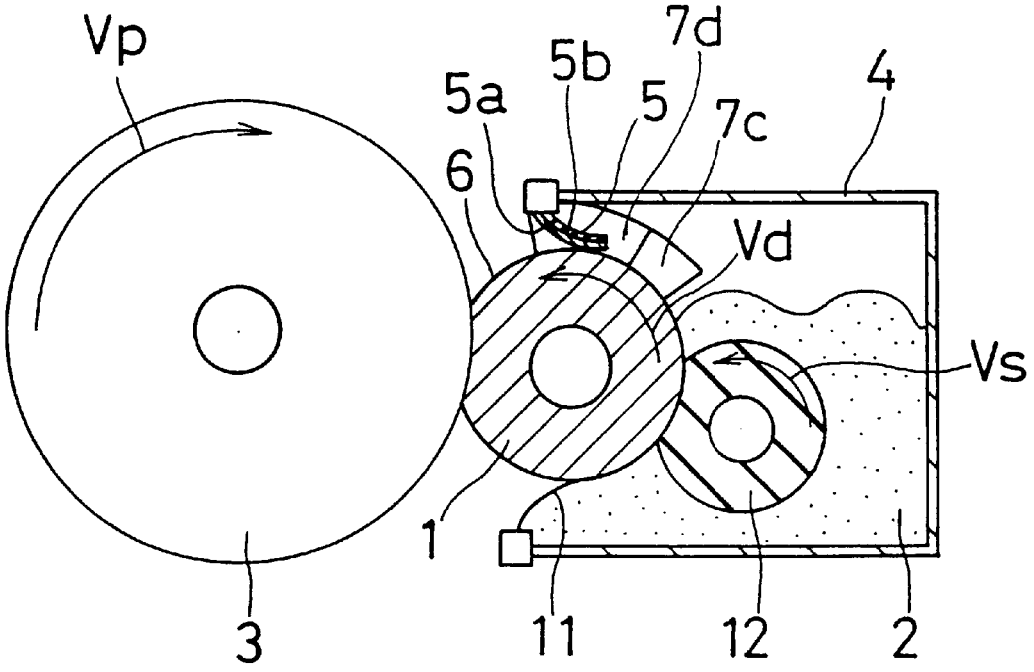
FIG. 8 is a sectional view for illustrating a construction of the developing apparatus according to one embodiment of the invention.

FIG. 8 schematically illustrates a developing apparatus wherein the sealing member 7 of FIG. 1 is divided into sealing segments 7*c* and 7*d* of different materials along the peripheral surface of the developer carrier, which segments are arranged along the peripheral surface of the developer carrier 1 in contact therewith.

As to the respective elasticities of the elastic sealing segments 7*c* and 7*d*, the elastic sealing segment 7*c* on the upstream side along the direction of rotation of the developer carrier 1 has a greater elasticity than the elastic sealing segment 7*d* on the downstream side.

In this example, the upstream-side elastic sealing segment 7*c* with respect to the rotational direction of the developer carrier 1 is formed of a solid-state rubber having a hardness of 40° whereas the downstream-side elastic sealing segment 7*d* is formed of a polyurethane sponge having a hardness of 10°, whereby a difference in the elasticities is established.

Thus, the toner 2 moving to the opposite ends of the developer carrier 1 is principally blocked by the elastic sealing segment 7*c* of the greater elasticity but some toner 2 having failed to be blocked is wiped out by the elastic sealing segment 7*d* of the smaller elasticity. The arrangement shown in FIG. 8 provides a more positive prevention of the oversupply of toner 2 to the developer carrier 1, and hence, the contamination of the interior of the apparatus with scattered toner and the increased toner consumption are more positively prevented.

Additionally, the use of elastic fibers for the elastic sealing segment 7*d* of the smaller elasticity contributes to a further increased effect thereof for wiping out the toner. Consequently, the contamination of the interior of the apparatus with scattered toner and the increased toner consumption and the like may be more positively prevented.

It is to be noted that the developing apparatus of the invention may be effectively practiced by combined use of any of the constructions and materials set forth in the foregoing description thereof.

As a matter of course, the present invention should not be limited to the embodiments set forth in the foregoing description thereof and illustrated in the accompanying drawings but various changes and modifications may be made in the invention without departing from the spirit and scope thereof.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a toner carrier for transferring toner to a development position;

a layer-thickness regulating member for forming a toner layer having a predetermined thickness on the toner carrier by making contact in a leading edge or surface thereof, which surface exists in a vicinity of the leading edge with the toner carrier; and a supplier for supplying one-component toner to the toner carrier, the layer-thickness regulating member is a combination of a layer forming member for forming the toner layer and a vibration damping member for absorbing vibrational energy, wherein the layer forming member has an upstream end portion protruding from the vibration damping member and the vibration portion member contacts a substantial part of the surface of the layer forming member.

2. A developing apparatus comprising:

a toner carrier for transferring toner to a development position;

a layer-thickness regulating member for forming a toner layer having a predetermined thickness on the toner carrier by making contact in a vicinity of a leading edge with the toner carrier; and a supplier for supplying one-component toner to the toner carrier, the layer-thickness regulating member is a combination of a layer forming member for forming the toner layer and a vibration damping member for absorbing vibrational energy, wherein the vibration damping member is made of a metal.

3. The developing apparatus of claim 1, wherein the vibration damping member is made of a rubber material.

4. The developing apparatus of claim 1, wherein the vibration damping member is made of a soft foam material.

5. The developing apparatus of claim 4, wherein the soft foam material is of an independent-cellular structure.

6. The developing apparatus of claim 1, wherein at least a part of the vibration damping member is made of a fluoro rubber foam.

7. A developing apparatus comprising:

a toner carrier for transferring toner to a development position;

a layer-thickness regulating member which is a combination of a layer forming member for forming the toner layer and a vibration damping member for absorbing vibration energy for forming a toner layer having a predetermined thickness on the toner carrier by making contact in a leading edge or surface thereof, which surface exists in a vicinity of the leading edge with the toner carrier;

a sealing member pressed against the layer-thickness regulating member; and a supplier for supplying one-component toner to the toner carrier, wherein at least one segment of the sealing member is made of a soft foam material of an independent-cellular structure which is capable of absorbing vibrational energy.

8. A developing apparatus comprising:

a toner carrier for transferring toner to a development position;

a layer-thickness regulating member which is a combination of a layer forming member for forming the toner layer and a vibration damping member for absorbing vibration energy for forming a toner layer having a predetermined thickness on the toner carrier by making contact in a leading edge or surface thereof, which surface exists in a vicinity of the leading edge with the toner carrier;

a sealing member pressed against the layer-thickness regulating member; and a supplier for supplying one-component toner to the toner carrier, wherein at least one segment of the sealing member is made of a fluoro rubber capable of absorbing vibrational energy.

9. A developing apparatus comprising:

a toner carrier for transferring toner to a development position;

a layer-thickness regulating member which is a combination of a layer forming member for forming the toner layer and a vibration damping member for absorbing vibration energy for forming a toner layer having a predetermined thickness on the toner carrier by making contact in a leading edge or a surface thereof, which surface exists in a vicinity of the leading edge with the toner carrier;

a sealing member pressed against the layer-thickness regulating member; and a supplier for supplying one-component toner to the toner carrier, wherein the layer-thickness regulating member includes a layer forming member for forming the toner layer and a vibration damping member for absorbing vibrational energy configured to have a greater width than the layer forming member, so that it contacts the sealing member.

10. A developing apparatus comprising:

a toner carrier for transferring toner to a development position;

a layer-thickness regulating member for forming a toner layer having a predetermined thickness on the toner carrier by making contact in a leading edge or a surface thereof, which surface exists in a vicinity of the leading edge with the toner carrier;

a sealing member pressed against the layer-thickness regulating member; and a supplier for supplying one-component toner to the toner carrier, wherein the sealing member includes a plurality of sealing segments of different materials which segments are aligned in a width direction of the toner carrier, and wherein at least one segment of the sealing member is capable of absorbing vibrational energy.

11. A developing apparatus comprising:

a toner carrier for transferring toner to a development position;

a layer-thickness regulating member for forming a toner layer having a predetermined thickness on the toner carrier by making contact in a leading edge or a surface thereof, which surface exists in a vicinity of the leading edge with the toner carrier;

a sealing member pressed against the layer-thickness regulating member; and a supplier for supplying one-component toner to the toner carrier, wherein the sealing member includes a plurality of sealing segments of different materials which segments are aligned in a circumferential direction of the toner carrier, and wherein at least one segment of the sealing member is capable of absorbing vibrational energy.

12. The developing apparatus of claim 10 or 11, wherein at least one segment of the sealing member is formed of a bristled textile fabric or fibrous material.

13. A developing apparatus comprising:

a toner carrier for transferring toner to a development position;

a layer-thickness regulating member for forming a toner layer having a predetermined thickness on the toner carrier by making contact in a leading edge or surface thereof, which surface exists in a vicinity of the leading edge with the toner carrier;

a sealing member pressed against the layer-thickness regulating member; and a supplier for supplying one-component toner to the toner carrier, wherein a part of the sealing member is comprised of a vibration damping member disposed on a back side of the layer-thickness regulating member for absorbing vibrational energy, and wherein the vibration damping member in part has a smaller modulus of elasticity than the sealing member.

14. A developing apparatus comprising:

a toner carrier for transferring toner to a development position;

a layer-thickness regulating member for forming a toner layer having a predetermined thickness on the toner carrier by making contact in a leading edge or surface thereof, which surface exists in a vicinity of the leading edge with the toner carrier;

a supplier for supplying one-component toner to the toner carrier; and means including sealing members located at opposite ends of the toner carrier for absorbing vibrational energy so that a uniform toner layer-thickness is formed resulting in images of good quality, wherein each sealing member is a combination of two different materials along the peripheral surface of the toner carrier, wherein at least a part of the sealing member is made of a fluoro rubber capable of absorbing vibrational energy.

* * * * *